US006854413B2

(12) United States Patent
Jackson et al.

(10) Patent No.: US 6,854,413 B2
(45) Date of Patent: Feb. 15, 2005

(54) BOAT TOWER HINGE AND FOOTER ASSEMBLY

(75) Inventors: Thomas J. Jackson, Knoxville, TN (US); Steven W. Jackson, Knoxville, TN (US); Scott A. Jackson, Knoxville, TX (US); John R. Jackson, Knoxville, TN (US)

(73) Assignee: J & J Machine & Tool, Inc., Knoxville, TN (US)

( * ) Notice: Subject to any disclaimer, the term of this patent is extended or adjusted under 35 U.S.C. 154(b) by 0 days.

(21) Appl. No.: 10/619,855

(22) Filed: Jul. 15, 2003

(65) Prior Publication Data

US 2004/0011276 A1 Jan. 22, 2004

(51) Int. Cl.[7] ..... F15D 1/10

(52) U.S. Cl. ..... 114/343; 114/353; 114/361

(58) Field of Search ..... 114/343, 353, 114/361

(56) References Cited

U.S. PATENT DOCUMENTS

| | | | | |
|---|---|---|---|---|
| 6,044,788 | A | 4/2000 | Larson et al. | |
| 6,374,762 | B1 * | 4/2002 | Larson et al. | 114/253 |
| 6,711,783 | B2 * | 3/2004 | LeMole | 16/352 |

* cited by examiner

*Primary Examiner*—Jesus D. Sotelo
(74) *Attorney, Agent, or Firm*—Pitts & Brittian P.C.

(57) ABSTRACT

An apparatus for folding a boat tower, including a hinge assembly and a releasable footer. The hinge assembly has two members that pivot about a pivot point. At least one spring loaded bolt, or locking pin, engages a corresponding opening in one member, thereby locking the two members in fixed relation. The releasable footer has a bolt that engages an opening, thereby locking a releasable member to the footer body.

36 Claims, 12 Drawing Sheets

BOAT TOWER HINGE AND FOOTER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a hinge assembly and cooperating footer for boat towers. More particularly, this invention pertains to the hardware used for folding a boat tower, such as one used to pull a wakeboarder or skier. The hardware includes a hinge assembly that operates when a spring-loaded pin is retracted. The hardware also includes a footer that is used to secure an attachment point of the tower to the boat. The footer includes a spring-loaded pin that secures a tower post to the footer, which is attached to the boat.

2. Description of the Related Art

A popular recreational activity is to water ski or ride a wakeboard. A powerboat pulls a person on skis or a wakeboard, which, at an appropriate speed, allows the person to remain above the water. A pull-rope is towed by the powerboat and has a handle grasped by the person.

Powerboats employ various means for attaching the pull-rope to the boat. One means is a post located amidships that has a pull-rope attachment point above the gunwales. Another means is to use a tower that extends from the gunwales, over the cockpit, with a pull-rope attachment point at an elevated point on the tower. Because of the forces involved in pulling one or more persons behind a boat, the attachment point for the pull-rope must be structurally sound.

An example of such a boat tower is disclosed in U.S. Pat. No. 6,044,788, entitled "Water Sports Performance System and Method," by Larson, et al., on Apr. 4, 2000. This patent discloses a boat tower that can be rotated from an upright position to a lowered position having less overall height, thereby aiding in towing the boat and passing underneath low bridges. The tower is attached to the boat with pinned connections. The pins are removed from the aft connections and the tower rotates about the pins of the forward connections. This arrangement requires that the pins be removed from the connections, resulting in loose parts that must be stored. Also, the removal of the pins, depending upon their configuration, requires the use of tools.

It is an objective of this invention to provide means for folding or lowering a boat tower without having to use tools or maintain and store loose parts removed to fold the tower.

BRIEF SUMMARY OF THE INVENTION

According to one embodiment of the present invention, a folding tower with a pair of hinge assemblies and a pair of releasable footers is provided. Each hinge assembly includes two mating members that pivot about a center-point. The two mating members are secured together by a pair of spring-loaded retractable pins, or bolts, that engage openings in the mating members. When retracted, the pins release the mating members, allowing them to pivot relative to each other.

Each releasable footer is attached to a surface and has an opening with a spring-loaded retractable pin protruding into the opening. An insertable member has an opening that is engaged by the spring-loaded pin such that when the insertable member engages the footer opening, the spring-loaded pin engages the insertable member opening, thereby securing the insertable member to the footer.

In another embodiment, the folding tower has a pair of hinge assemblies and the tower end opposite the hinge assemblies has a releasable connection, thereby allowing the tower to fold after being released.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Apparatus for folding a boat tower is disclosed. The configuration of boat towers varies considerably. However, the need to easily reduce the height of the tower is a commonly felt need. Further, the need to be able to manipulate the tower without tools or loose parts is a commonly felt need. Toward this end, a boat tower is provided with hinges on one side and releasable connections on the other.

Figure 1A:
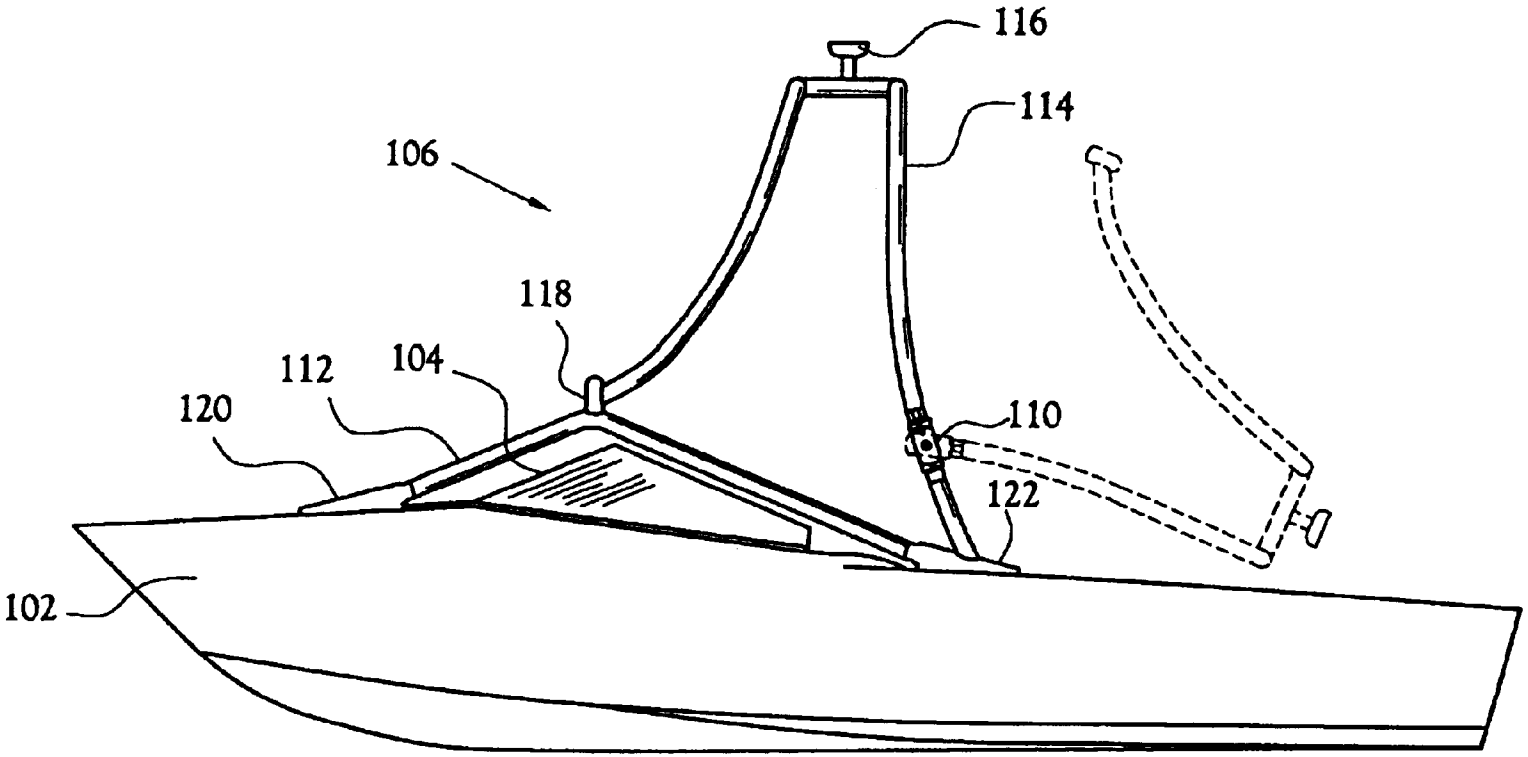
FIG. 1*a* is a side view of a powerboat with one type of a tower.
Figure 1B:
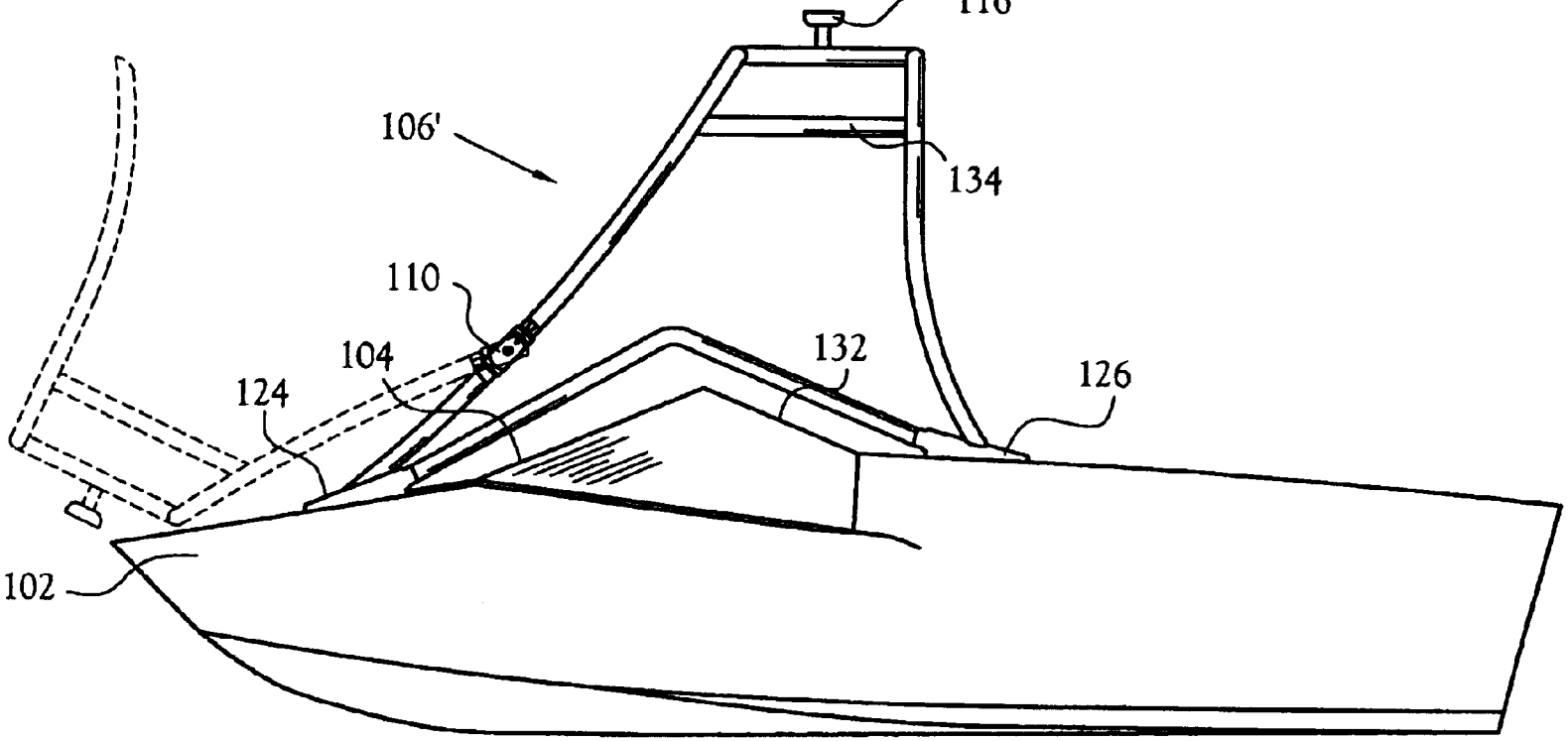
FIG. 1*b* is a side view of a powerboat with a second type of a tower.

FIGS. 1*a* and 1*b* illustrate two embodiments of boat towers for towing skiers and wakeboarders. Those skilled in the art will recognize that various configurations of towers can be used without departing from the spirit and scope of the present invention. Not illustrated are means for securing the wakeboards or skis to the sides of the towers. The towing tower 106 illustrated in FIG. 1*a* has a first strut 112 in which each end of the first strut 112 attaches to the gunwales on one side of a boat 102 at a footer 120, 122. One end of the second strut 114 attaches to the aft footer 122 and the other end of the second strut 114 releasably attaches to the first strut 112. The tower 106 has two first struts 112, one on each side of the boat 102. There are also two second struts 114, one for each first strut 112. Each of the first struts 112 may be connected with one or more cross-struts that typically follow the contours of the windshield 104. Each of the second struts 114 is connected with one or more cross-struts. One of the cross-struts connecting the two second struts 114 has a pull-rope connection point 116 located inline with the center of the boat 102.

The tower 106, in the lowered position, is illustrated in FIG. 1*a* in phantom. To lower the height of the tower 106, the second struts 114 are released from their connection to the first struts 112 at a releasable connection 118. A hinge assembly 110 is then unlocked, permitting the second struts 114 and associated cross-struts to pivot aft such that the pull-rope point 116 is brought toward the aft deck of the boat 102. With the hinge assembly 110 properly located, the upper portion of the tower 106 has a much lower height when folded than when it is in its normal, ready to use position.

FIG. 1*b* illustrates a second configuration of a towing tower 106'. In this configuration, a pair of first struts 132 are attached to the gunwales, but does not provide structural support to the second struts 134. The first struts 132 typically have a cross-strut that follows the contours of the windshield 104. Each pair of second struts 134 attach to a forward footer 124 and an aft footer 126. The attachment to the aft footer 126 is a releasable connection. The second struts 134, in the illustrated configuration have a structural strut 136 and one or more cross-struts, to one of which the pull-rope point 116 is attached.

The tower 106', in the lowered position, is illustrated in FIG. 1*b* in phantom. To lower the tower 106', the aft end of the second strut 134 is released from the aft footer 126 and the hinge assembly 110 is unlocked to permit the second strut 134 to fold toward the bow of the boat 102. With the hinge assembly 110 properly located, the upper portion of the tower 106' has a much lower height when folded than when it is in its normal, ready to use position.

The novel design of the hinge assembly 110 and footer 126 presented herein allows the user to fold the tower 106, 106' without resort to tools. In other words, the present invention permits the tower 106, 106' to be quickly folded by manipulating the tower 106, 106' by hand, with no loose components or screws that are separate from the tower components.

Figure 2:
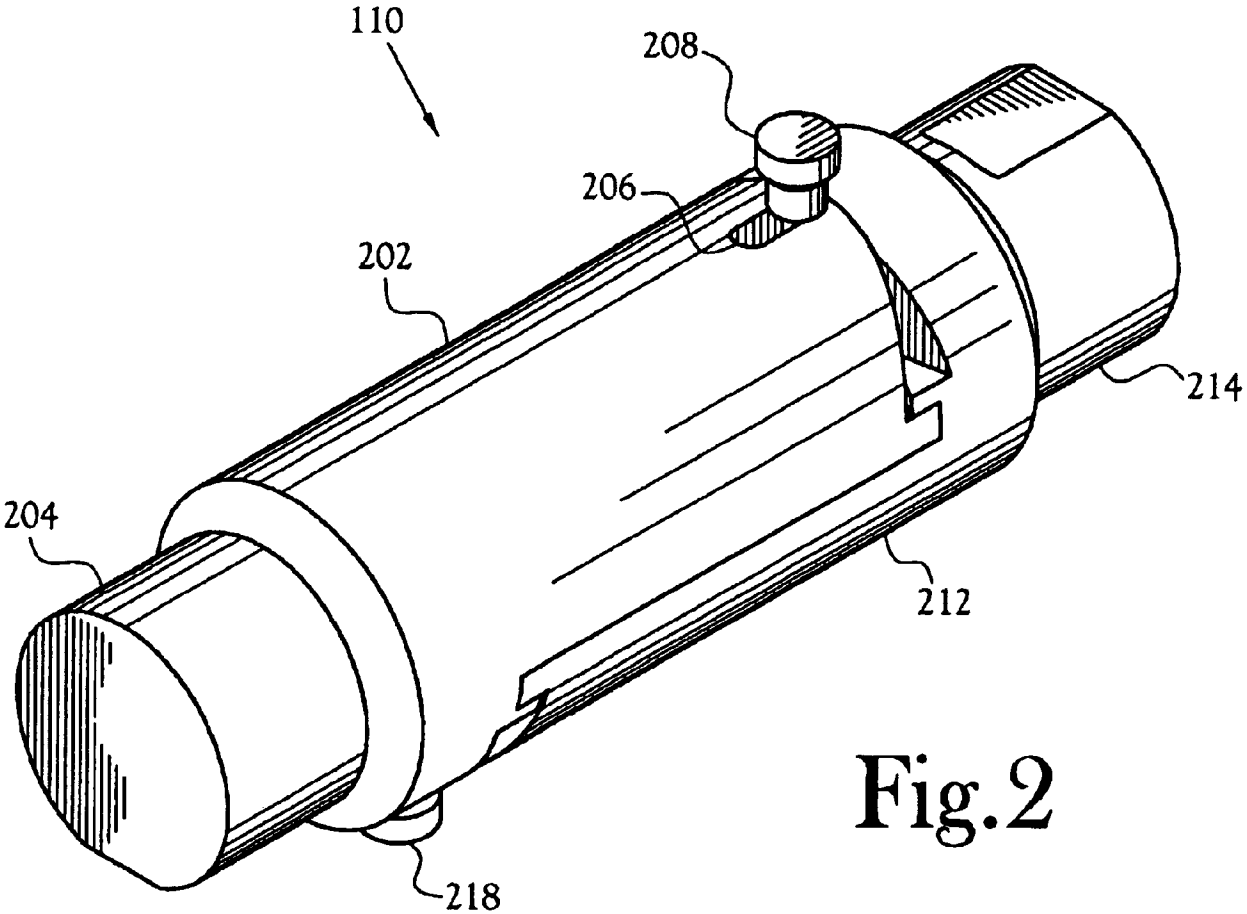
FIG. 2 is a perspective view of one embodiment of a hinge assembly.

FIG. 2 illustrates one embodiment of the hinge assembly 110 in its locked position, which in the illustrated embodiment, is an extended position in which the two ends 204, 214 are diametrically opposite. The hinge assembly 110 performs the function of pivoting one portion of the tower 106, 106' relative to the other, such as when folding the tower 106, 106'. The hinge assembly 110 includes two mating halves, or members, 202 and 212. Each half 202 and 212 has a protrusion 204 and 214 adapted for receiving tubing, which is welded in place. Each half 202 and 212 includes an operator 208 and 218 used for locking the hinge assembly 110 in the locked position. The operator 208 and 218 moves longitudinally in the slotted opening 206.

Figure 3:
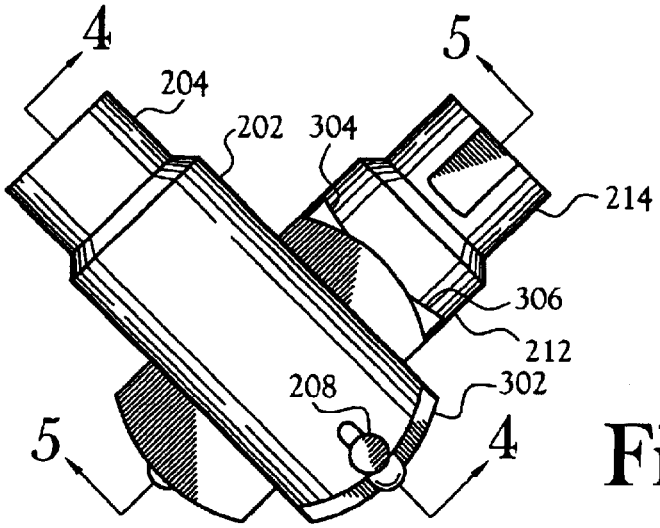
FIG. 3 is a view of the hinge assembly in a partially folded position.

FIG. 3 illustrates the hinge assembly 110 in the unlocked position in which the two halves, or members, 202 and 212 are free to rotate about a pivot point. The two halves 202 and 212 rotate approximately 135 degrees in either direction, relative to each other.

Figure 4:
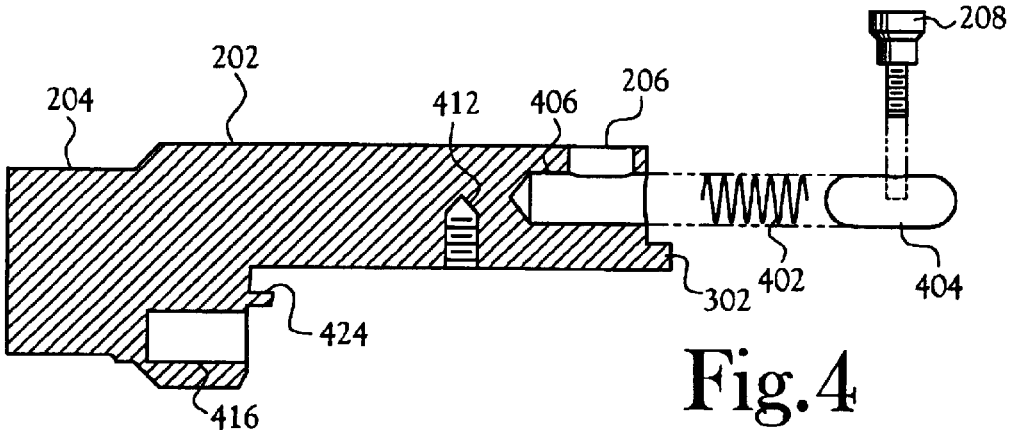
FIG. 4 is a cross-sectional view of half of the hinge assembly.

FIG. 4 is a cross-section of the first half, or first member, 202 of the hinge assembly 110, which aids in understanding the construction and operation of the hinge assembly 110. A spring 402 and a bolt 404 are inserted into an opening 406 and the operator 208 screws into the bolt 404, thereby capturing the bold 404 in the opening 406. Moving the operator 208 longitudinally along the slotted opening 206 causes the bolt 404 to slide along the opening 406. The spring 402 causes the bolt 404 to have a normally extended position in which a portion of the bolt 404 extends from the end of the first half 202. With the hinge assembly 110 in the locked position, the bolt 404 in the extended position engages an opening 516 (seen in FIG. 5) in the second half 212. In the illustrated embodiment, the bolt 404 is a cylindrical bar with rounded ends.

Moving the operator 208 longitudinally towards the pivot point 412 causes the bolt 404 to retract such that no portion of the bolt 404 extends from the end of the first half 202. The slotted opening 206 serves to restrain the longitudinal movement of the operator 206 and, consequently, the bolt 404.

Figure 5:
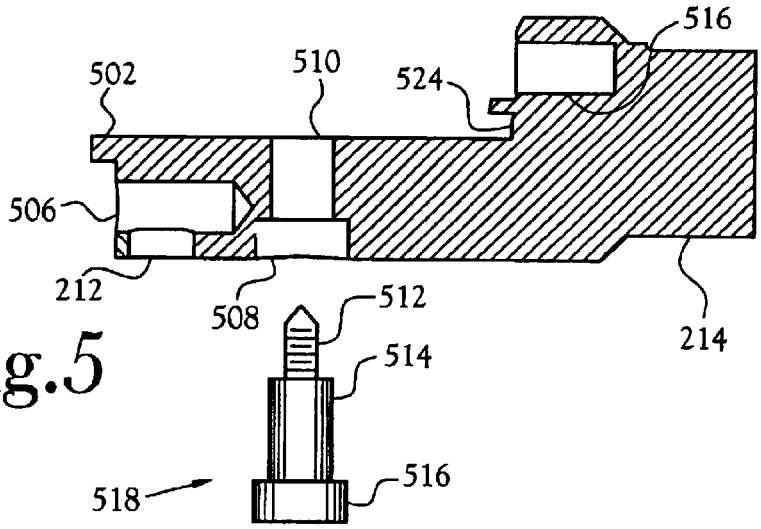
FIG. 5 is a cross-sectional view of the other half of the hinge assembly.

FIG. 5 is a cross-section of the second half, or second member, 212 of the hinge assembly 110. The second half 212 has an opening 516 to receive the portion of the bolt 404 that extends from the first half 202. The second half 212 has a second bolt, spring, and operator (not illustrated) that correspond to those of the first half 202.

Illustrated in FIG. 5 is a pivot bolt 518, which passes through the second half 212 and engages a threaded hole 412 on the first half 202. The pivot bolt 518 has a shoulder 514 that passes through an opening 510 in the second half 212, and the pivot bolt 518 has a head 516 that engages a shoulder in a wider opening 508 in the second half 212. The threaded part 512 of the pivot bolt 518 engages the blind threaded hole 412 on the first half 202 and the pivot bolt 518 is tightened such the bolt shoulder 514 rests against the first half 202. In this tightened position, the head 516 of the pivot bolt 518 has a slight clearance with the shoulder of the wider opening 508, thereby allowing the second half 212 to freely rotate about the pivot bolt 518, with the bolt shoulder 514 and the opening 510 serving as a bearing.

Figure 6:
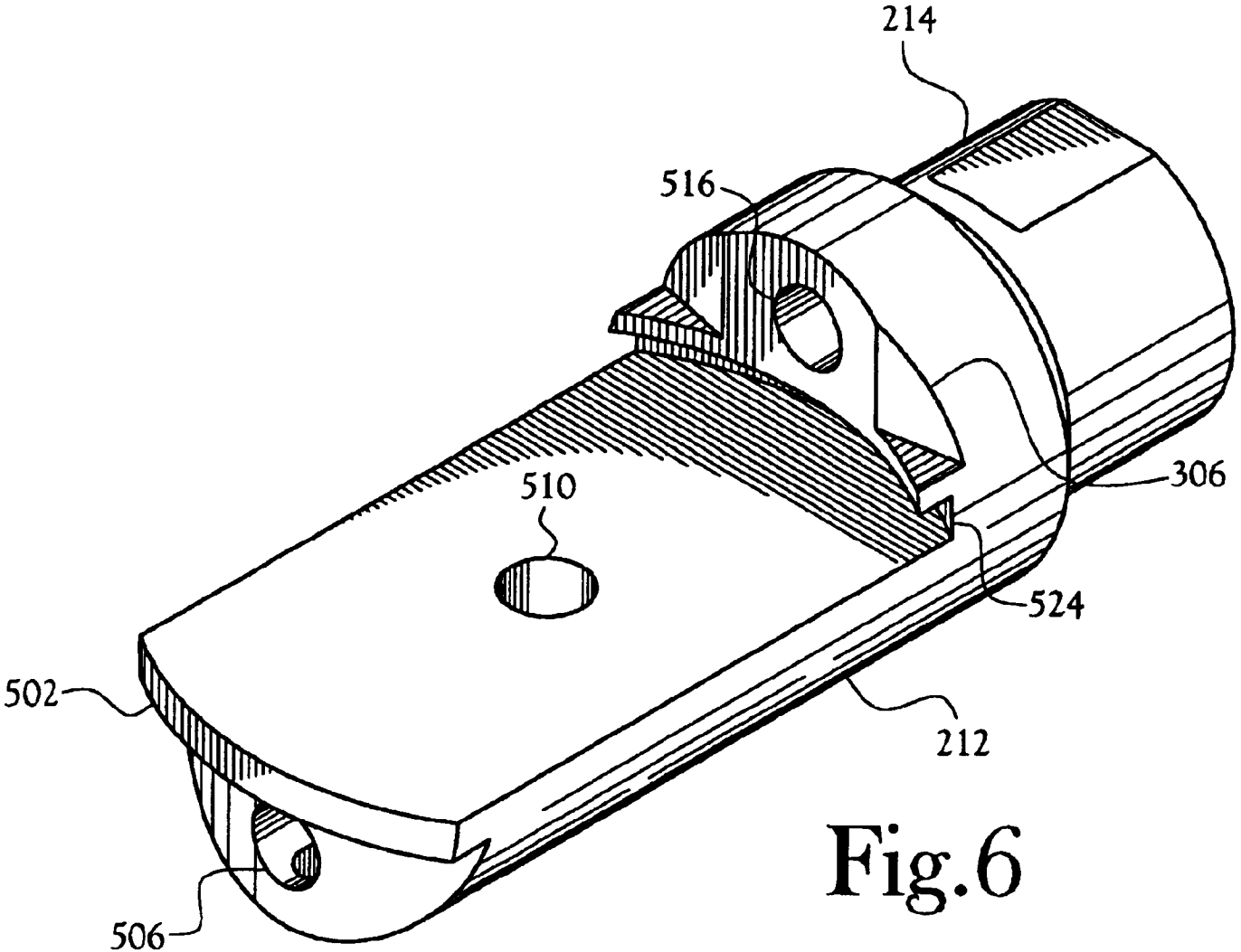
FIG. 6 is an isometric view of one half of the hinge assembly.

FIG. 6 illustrates one half 212 of the hinge assembly 110 in an isometric view. The slot 524 for engaging the lip 302 of the other half 202 is shown. Above the slot 524 is the chamfer 306 adjacent the opening 516 for receiving the exposed end of the bolt 404.

Each half 202 and 212 has a lip 302 and 502 that engages a slot 424 and 524 in the other half 212 and 202 when the hinge assembly 110 is in a locked position. The strength of the hinge assembly 110 in the locked position is a combination of the pivot bolt 518, the bolts 404 pinning the two halves 202 and 212 together, and the lips 302 and 502 engaging the slots 424 and 524. In one embodiment, the two halves 202 and 212 are made of aluminum, and the other components are made of stainless steel. Because of the marine environment to which the hinge assembly 110 is exposed, these materials have the advantage of being corrosion resistant, while still having sufficient strength for their application.

Each half 202 and 212 has two chamfers 304 and 306 located on opposite sides of the opening 406 and 506. The chamfers 304 and 306, in combination with the rounded ends of the bolts 404, allow the hinge assembly 110 to be placed in the locked position without retracting the bolts 404. As the two halves 202 and 212 are brought into alignment before reaching the locked position, the rounded end of the bolts 404 strike the associated chamfer 304 or 306, which causes the bolt 404 to be pushed into the opening 406 and 506 against the spring 402 pressure. After the bolts 404 are aligned with the openings 516 and 416, the springs 402 push the ends of the bolts 404 into the openings 516 and 416, thereby locking the hinge assembly 110 in the locked position.

Figure 7:
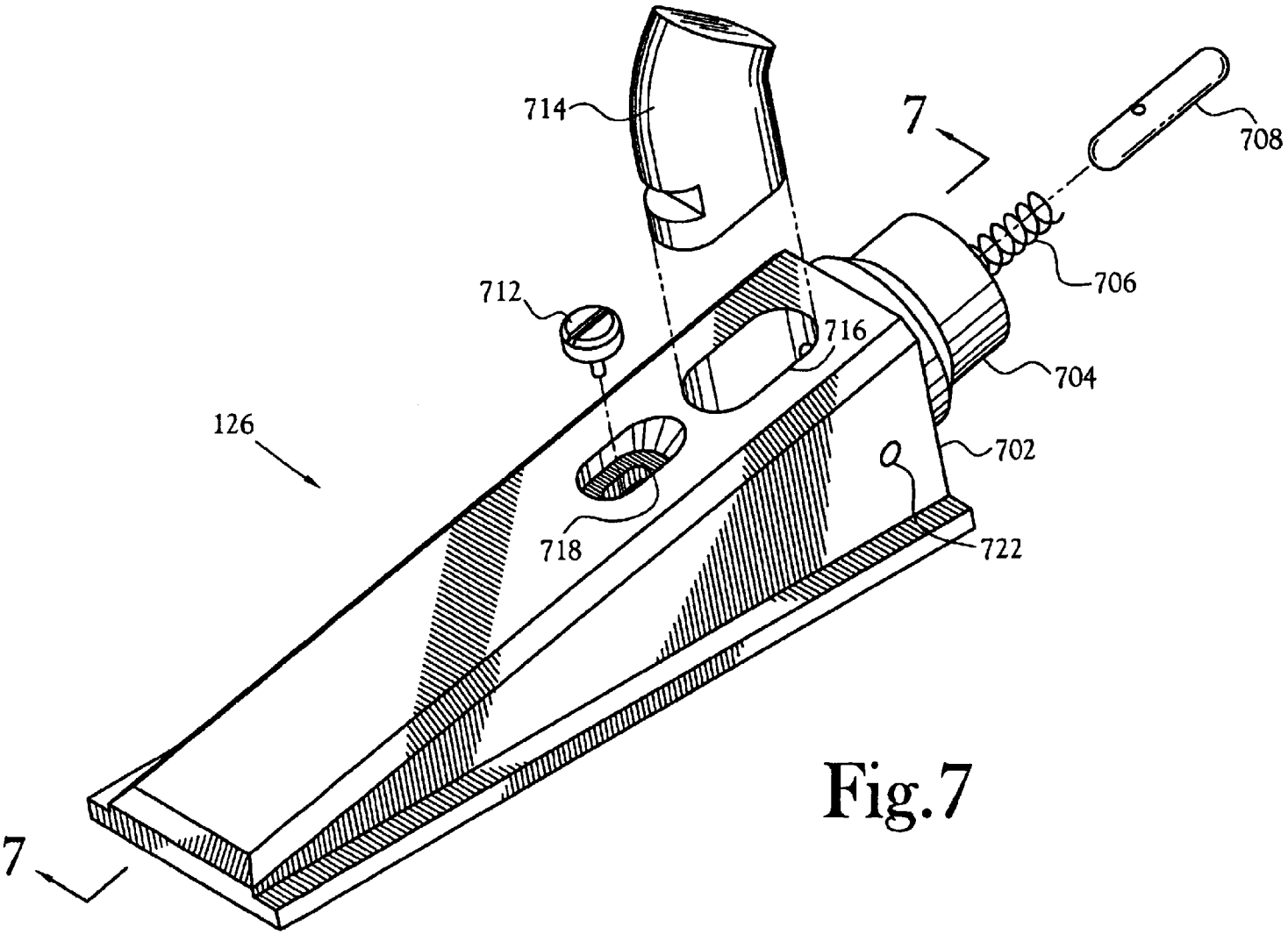
FIG. 7 exploded perspective view of the footer.

FIG. 7 is an exploded perspective view of a releasable footer 710. The footer 710 performs the function of releasably securing a portion of the tower 106, 106' to the boat 102. The footer body 702 is attached to a surface of the boat 102 and has a protrusion 704 adapted for connection to a tower tube. A releasable member 714 fits into a first opening 716. The footer operator 712 is connected to the footer bolt 708, which has pressure applied to it by the footer spring 706. The first opening 716 has a weep hole 722, which allows water to drain from the first opening 716. The weep hole 722 extends from the side of the body 702 to the bottom of the first opening 716. In one embodiment, the weep hole 722 is a drilled hole.

Figure 8:
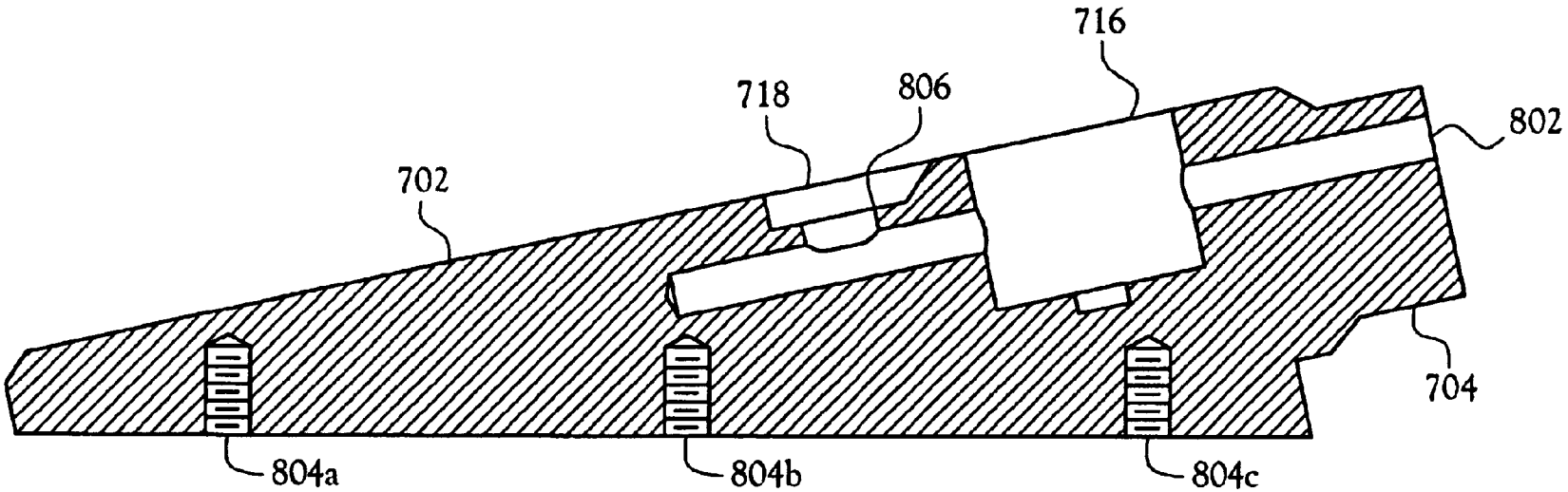
FIG. 8 is a cross-section view of the footer.

FIG. 8 illustrates a cross-sectional view of the footer body 702. The illustrated embodiment has three threaded openings 804*a*, 804*b*, and 804*c* with which the body 702 is secured to the boat 102. Those skilled in the art will recognize that other attachment means, for example studs protruding from the body 102, can be used without departing from the spirit and scope of the present invention. Additionally, those skilled in the art will recognize that the number of attachment points on the base of the body 702 can vary without departing from the spirit and scope of the present invention.

Figure 9:
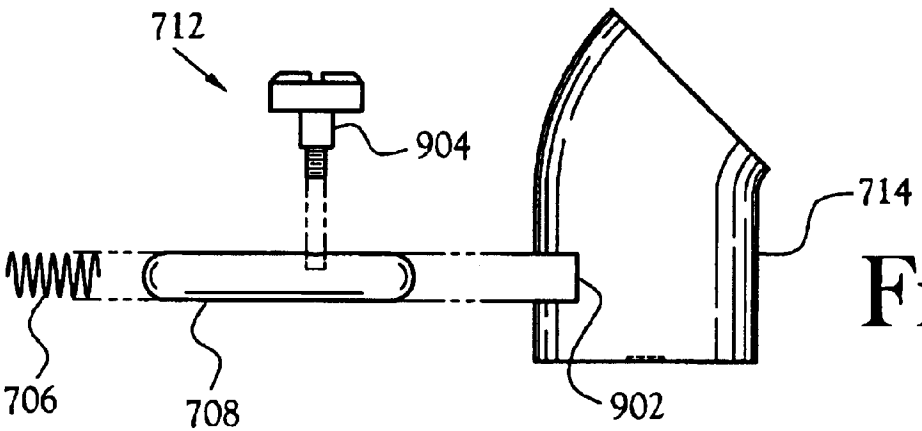
FIG. 9 is an exploded view of the pin and insertable member.

FIG. 9 illustrates the spring 706, the footer bolt 708, the footer operator 712, and the releasable member 714. In the illustrated embodiment, the releasable member 714 has an end that fits into the first opening 716 and an opposing end that is adapted to mate with a section of flattened tower tubing. Those skilled in the art will recognize that the angle between the two ends of the releasable member 714 can vary without departing from the spirit and scope of the present invention. In another embodiment, the releasable member 714 fits into the first opening 716 and does not have an opposing end for connecting to the tower tubing, rather, it is cut flush with the top surface of the footer body 702. This embodiment is suitable for a footer without an attached strut, such as when a tower 106, 106' is removed from a boat 102.

A bored hole 802 through a portion of the body 702 is for inserting the footer spring 706 and footer bolt 708. A countersunk opening 718 intersects the bored hole 802. The countersunk opening 718 receives the footer operator 712, which, in the illustrated embodiment, is a screw with a shoulder 904. The shoulder 904 moves within the slotted opening 806. The footer bolt 708 slides along the bored hole 802 and one end of the footer bolt 708 engages the slot 902 in the releasable member 714. The footer spring 706 pushes the bolt 708 into the slot 902. To release the releasable member 714, the footer operator 712 is slid away from the releasable member 714, thereby retracting the footer bolt 708 from the slot 902 in the releasable member 714 and allowing the releasable member 714 to be removed from the first opening 716. The illustrated embodiment shows the slot 902 as a rectangular opening cut into the releasable member 714; however, one skilled in the art will recognize that the slot 902 can be any shaped opening adapted to receive the footer bolt 708 without departing from the spirit and scope of the present invention. For example, in one embodiment, the slot 902 is a hole bored or drilled in the releasable member 714. In still another embodiment, the hole has a chamfered edge to aid in the alignment of the footer bolt 708 with the hole.

To secure the releasable member 714, the footer operator 712 is slid away from the first opening 716 such that the footer bolt 708 is retracted into the bored hole 802 and does not extend into the first opening 716. The releasable member 714 is then placed in the first opening 716 with the slot 902 orientated toward the bolt 708, and the footer operator 712 is released, thereby allowing the footer spring 706 to push the footer bolt 708 into the slot 902.

Figure 10:
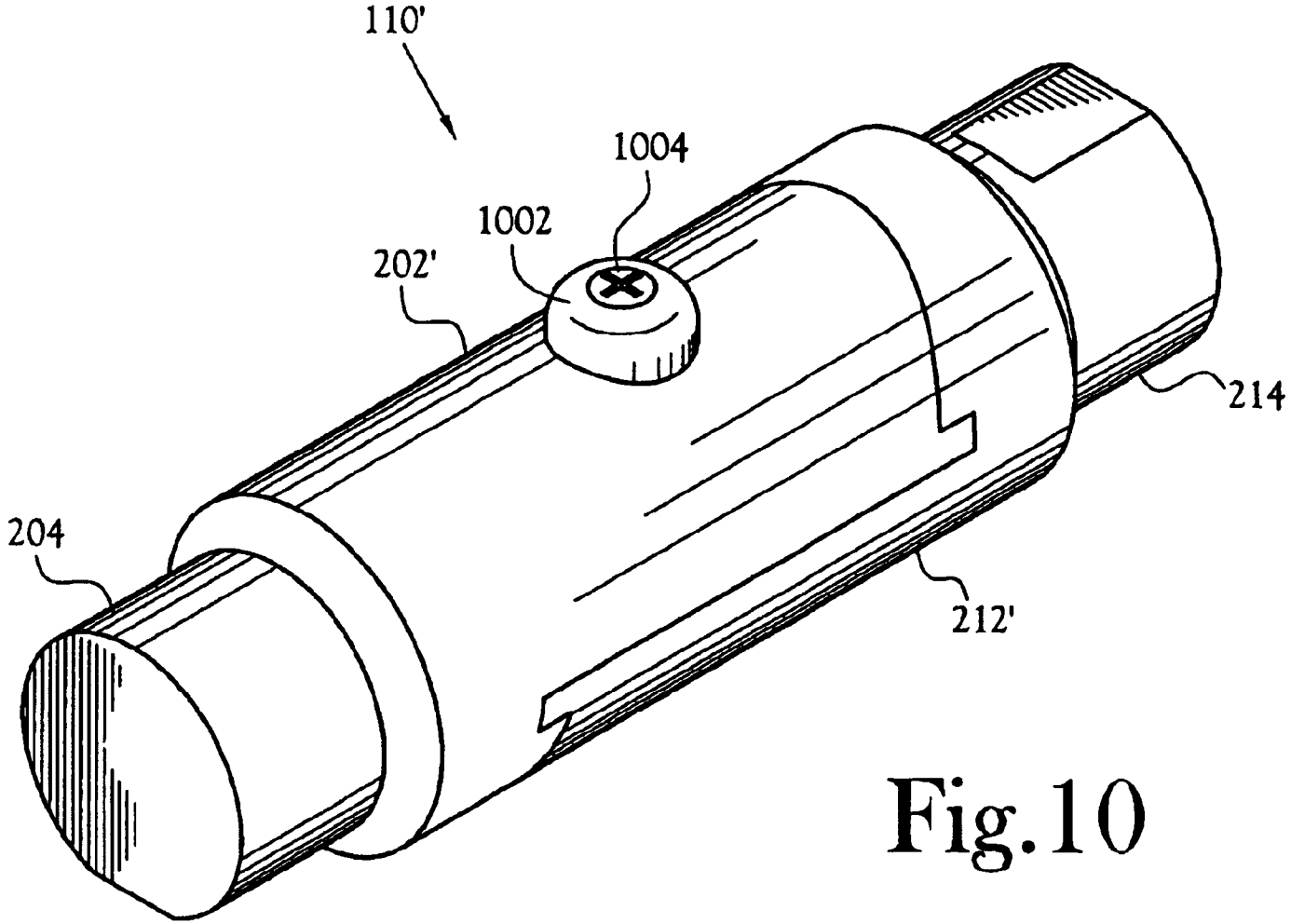
FIG. 10 is a perspective view of another embodiment of the hinge assembly.

FIG. 10 illustrates another embodiment of the hinge assembly 110' in its locked position. The hinge assembly 110' is operated by pressing a pushbutton 1002 located on the axis of the pivot point of the hinge assembly 110'. Pushing the pushbutton 1002 allows the two members 202' and 212' to rotate relative to each other. A fastener 1004 secures the pushbutton 1002 to the internal portion of the hinge operator. The illustrated embodiment shows a pushbutton 1002 that fits into a circular opening 1102. Those skilled in the art will recognize that pushbuttons 1002 and their corresponding openings 1102 can have other shapes without departing from the scope and spirit of the present invention.

Figure 11:
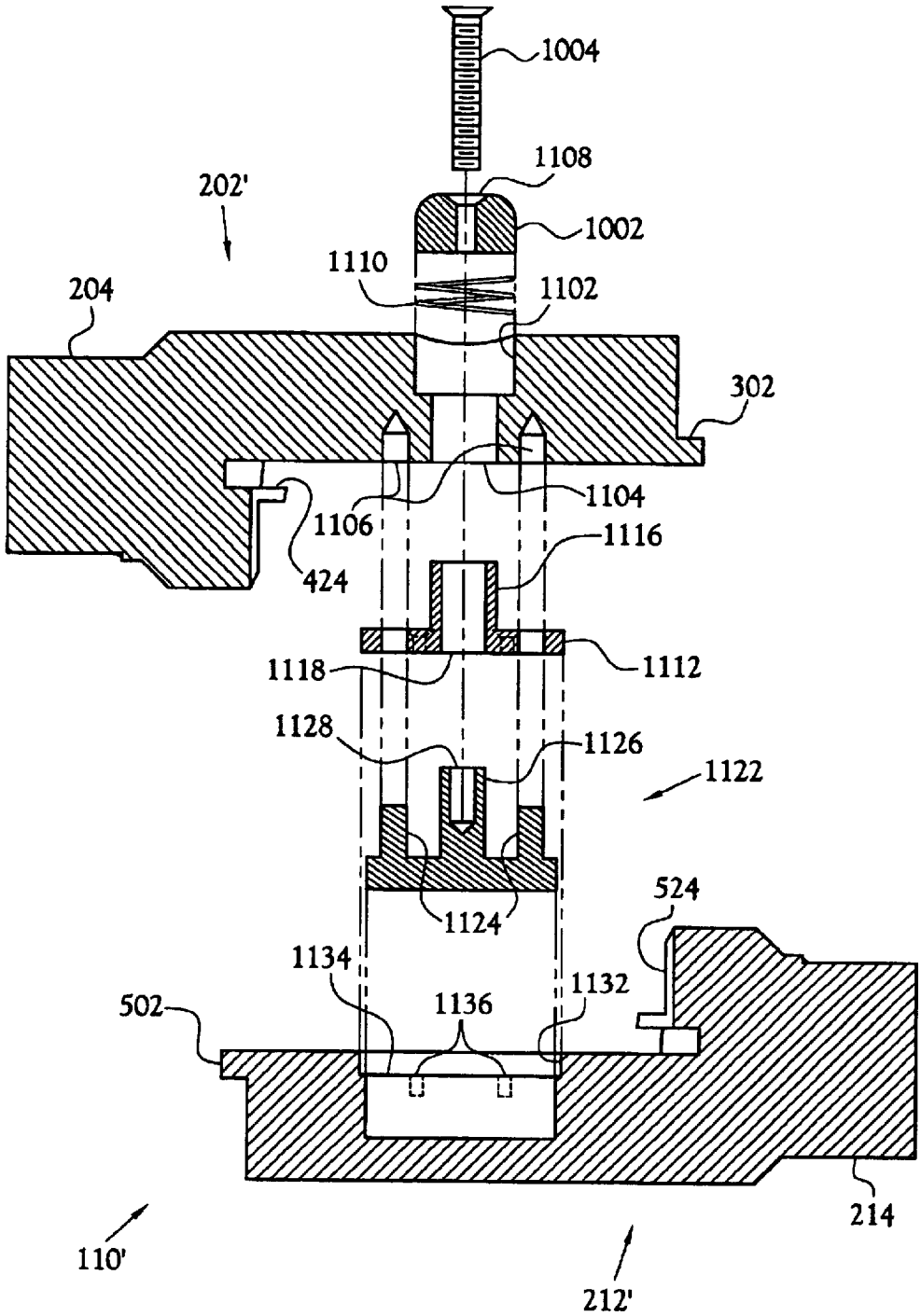
FIG. 11 is an exploded cross-sectional view of the embodiment of the hinge assembly illustrated in FIG. 10.

FIG. 11 illustrates the embodiment of the hinge assembly 110' shown in FIG. 10. The pushbutton fastener 1004 fits into an opening 1108 in the pushbutton 1002. The fastener 1004 fits into the opening 1128 in the shaft 1126 of the locking assembly 1122. The bottom of the pushbutton 1002 engages a spring 1110 that rests in an opening 1102, which is on the outside surface of the first member 202'.

Figure 12:
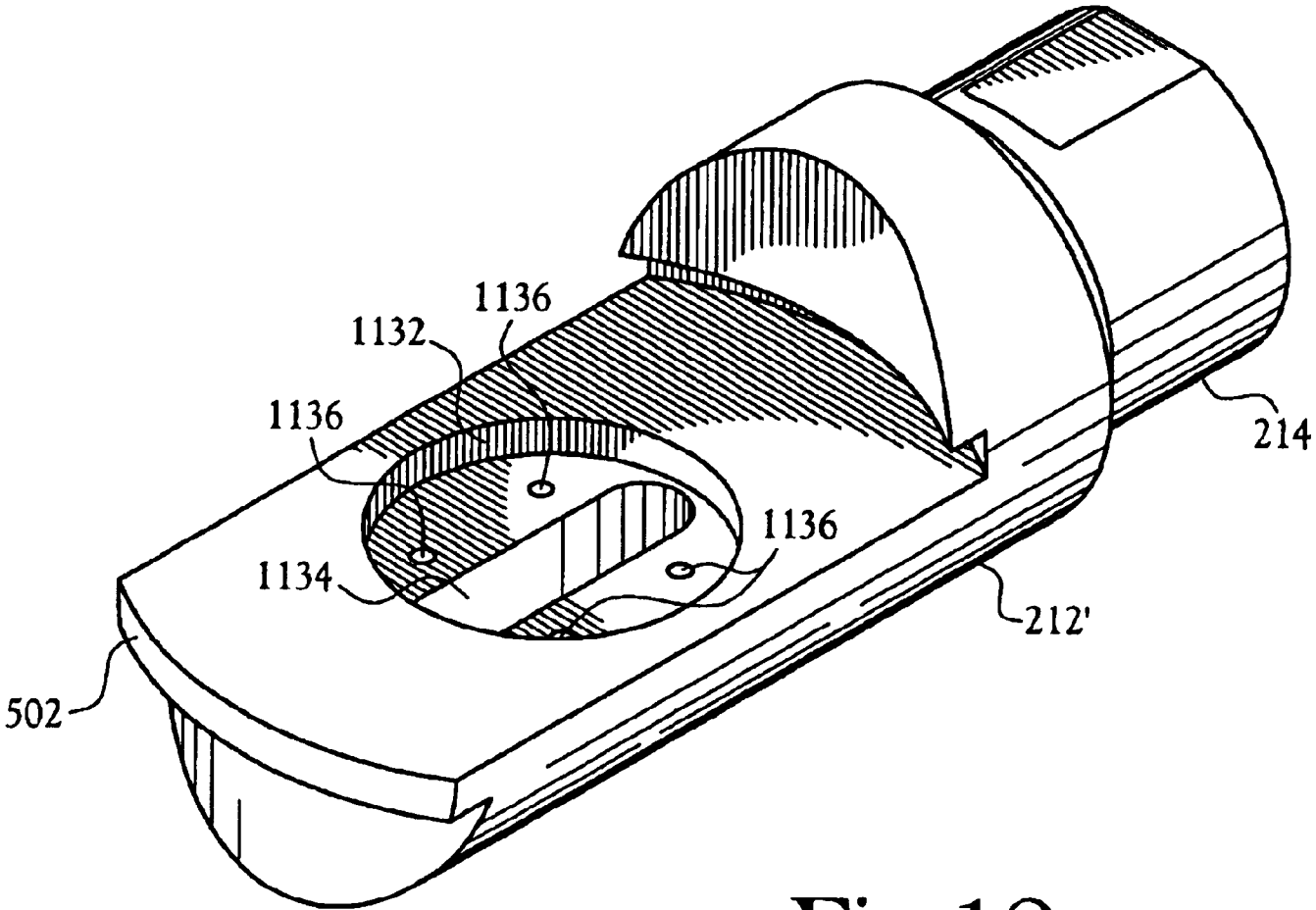
FIG. 12 is a perspective view of the embodiment of a second hinge member illustrated in FIG. 10.

FIG. 12 is a perspective view of the second member 212'. The locking assembly 1122 fits into the recess 1134 in the second member 212'. The rotating lock plate 1112 fits into the round recess 1132 in the second member 212'. The shaft 1126 of the locking assembly 1122 has a sliding fit with the opening 1118 in the shaft 1116 of the rotating lock plate 1112. The shaft 1116 of the rotating lock plate 1112 has a sliding fit with the opening 1104 in the first member 202'. The locking assembly 1122 has two locking pins, or bolts, 1124 parallel to the shaft 1126. Those skilled in the art will recognize that the number of locking pins can vary without departing from the scope and spirit of the present invention. In the discussion of this embodiment of the hinge assembly 110', the two locking pins, or bolts, 1124 are called locking pins 1124 to avoid confusion with the bolts 404 discussed in the other embodiment of the hinge assembly 110. However, one skilled in the art will recognize that whether the device is called a locking pin 1124 or a bolt 404, the device serves to lock the first member 202, 202' and second member 212, 212' in a fixed, locked position. The locking pins, or bolts, 404, 1124 are elongated members that engage corresponding openings 516, 1106. With one end of the locking pins, or bolts, 404, 1124 secured and the other end of the locking pins, or bolts, 404, 1124 engaging the corresponding opening 516, 1106, the locking pins, or bolts, 404, 1124 shear strength prevents movement between the first member 202, 202' and second member 212, 212'.

Figure 13:
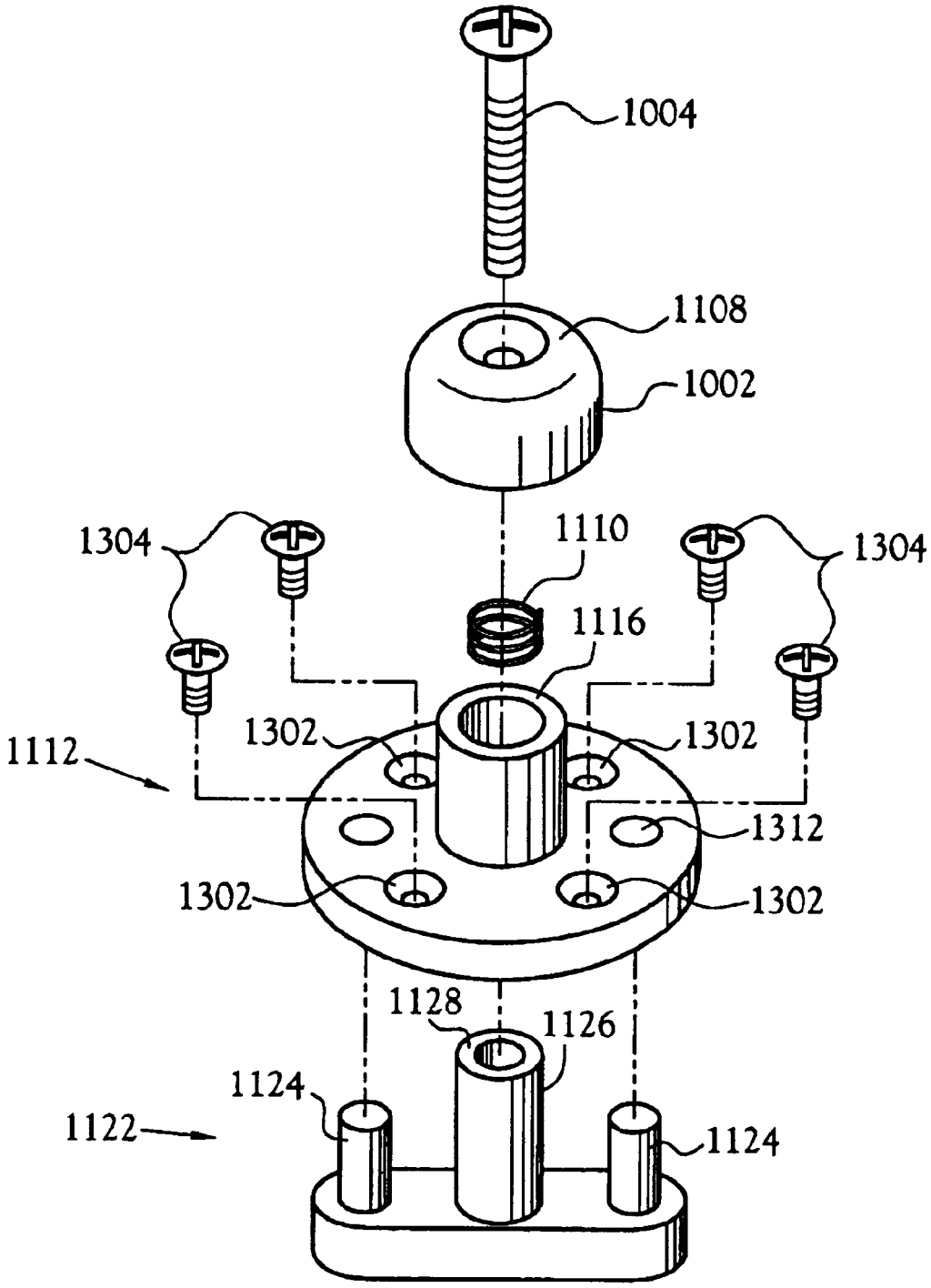
FIG. 13 is an exploded view of the embodiment of the hinge operator mechanism illustrated in FIG. 10.

FIG. 13 is an exploded view of the operator for the embodiment illustrated in FIG. 10. The rotating lock plate 1112 has four countersunk holes 1302 for receiving four fasteners 1304. These fasteners 1304 secure the flange of the rotating lock plate 1112 to the second member 212' by engaging threaded openings 1136 in the second member 212' (illustrated in FIG. 11). Those skilled in the art will recognize that the number of fasteners 1304, along with the corresponding openings 1136 and 1302, may vary without departing from the scope and spirit of the present invention. The secured rotating lock plate 1112 holds captive the locking assembly 1122, which has locking pins 1124 sliding through the openings 1312 in the rotating lock plate 1112.

Figure 14A:
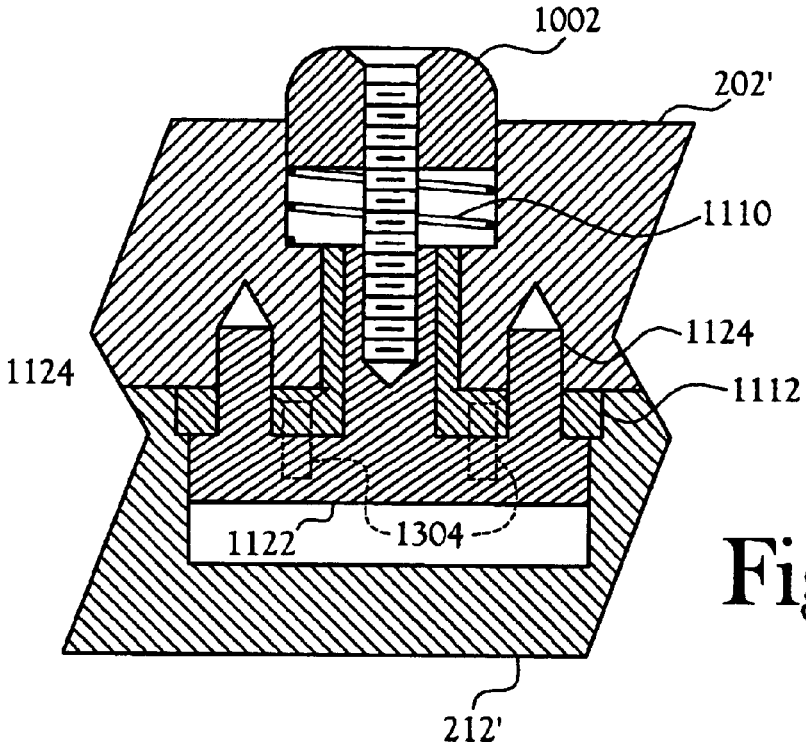
FIGS. 14*a* and 14*b* are cross-sectional views illustrating the normal and actuated position, respectively, of the operator mechanism illustrated in FIG. 10.
Figure 14B:
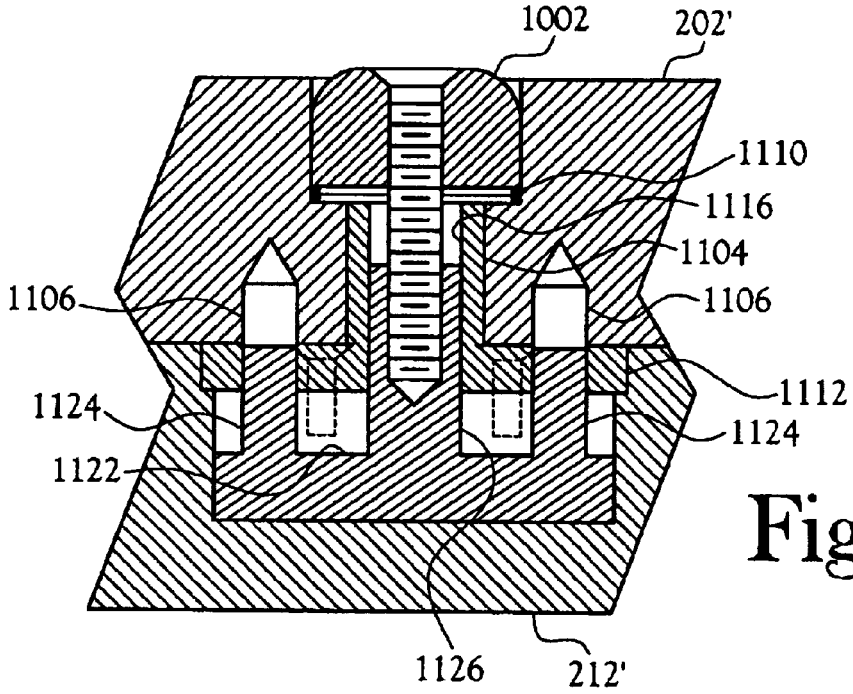

FIGS. 14*a* and 14*b* are cross-sectional views illustrating the normal and actuated position, respectively, of the operator mechanism illustrated in FIG. 10. In the normal position illustrated in FIG. 14*a*, the spring 1110 pushes the pushbutton 1002 away from the first member 202', thereby forcing the locking pins 1124 to engage the corresponding openings 1106 in the first member 202' and locking the first member 202' to the second member 212'. In the actuated position illustrated in FIG. 14*b*, the pushbutton 1002 compresses the spring 1110, pushes the locking assembly 1122 away from the first member 202', and disengages the locking pins 1124 from the openings 1106 in the first member 202'. In the actuated position, the shaft 1116 of the rotating lock plate 1112 rotates within the opening 1104 in the first member 202', thereby allowing the first member 202' to rotate, or pivot, relative to the second member 212'

The embodiment of the hinge operator illustrated in FIGS. 10 to 14*b* operates to lock the hinge assembly 110' in the locked position by the spring 1110 pressure forcing the locking pins 1124 into the openings 1106 in the first member 202', thereby fixing the first member 202' in relation to the second member 212'. With the hinge assembly 110' in the locked position, the locking pins 1124 engaging the corresponding openings 1106 in the first member 202' function to prevent the two members 202' and 212' from rotating about the pivot point, which is centered on the longitudinal axis of the pushbutton 1002, and from the two members 202' and 212' moving apart from each other along their longitudinal axis. The rotating lock plate 1112, in cooperation with the locking pins 1124 on the locking assembly 1122, function to fix the locking pins 1124 to the second member 212'. The lips 302 and 502 engaging the corresponding slots 424 and 524 function to strengthen the hinge assembly 110' in the locked position. This strengthening is accomplished by restraining the freedom of movement of the two members 202' and 212' relative to each other, other than about the pivot point. The spring functions to force the locking pins 1124 to engage the corresponding openings 1106 in the first member 202'.

Depressing the pushbutton 1002 forces the locking assembly 1122 away from the first member 202' and disengages the locking pins 1124 from the openings 1106 in the first member 202'. The pushbutton 1002 and spring 1110 function to force the locking pins 1124 out of engagement with the openings 1106 in the first member 202'. The shaft 1116 cooperating with the opening 1104 in the first member 202' function as a pivot, allowing the first and second members 202' and 212' to pivot about each other with the corresponding surfaces of the shaft 1116 and the opening 1104 functioning as a bearing.

From the foregoing description, it will be recognized by those skilled in the art that a folding tower 106, 106' utilizing a pair of hinge assemblies 110 and releasable feet 126 have been provided. The tower is adapted to be folded without resort to tools, thereby resulting in the boat 102 having less height above the waterline.

One embodiment of the hinge assembly 110 has first and second members 202 and 212 that pivot about a pivot bolt 518. Each member 202 and 212 has a spring-loaded bolt 404 that, in the extended position, engages an opening 516 and 416 in the other member 212 and 202, thereby locking the two members 202 and 212 in fixed relation in the locked position. Each member 202 and 212 also has a lip 302 and 502 and a corresponding slot 524 and 424. The lip 302 and 502 of each member 202 and 212 engages the slot 524 and 424 of the other member 212 and 202 when the hinge assembly 110 is in the locked position. Each member 202 and 212 has a chamfer 304 and 306 adjacent the opening 406 and 506 that receives the bolt 404 from the other member 212 and 202. The chamfer 304 and 306 engages the bolt 404 and forces it into the member 202 and 212, thereby allowing the members 202 and 212 to lock without requiring operator intervention to retract the bolts 404.

Another embodiment of the hinge assembly 110' has first and second members 202' and 212' that pivot about a shaft 1116 and the opening 1104 in the first member 202'. The first member 202' has an opening 1102 into which a spring 1110 and a pushbutton 1002 fit. The pushbutton 1002 is connected to a locking assembly 1122, which has locking pins 1124 that engage openings 1106 in the first member 202' when the hinge assembly 110' is in the locked position. The locking assembly 1122 and the locking pins 1124 are restrained in the second member 212' by a rotating lock plate 1112 having openings 1312 that receive the locking pins 1124. The rotating lock plate 1112 is secured to the second member 212'. The first and second members 202' and 212' have lips 302 and 502 and corresponding slots 524 and 424 that function to strengthen the hinge assembly 110' in the locked position.

Both of the illustrated embodiments of the hinge assembly 110 and 110' utilize a hand operated mechanism that is captive with the hinge assembly 110 and 110'. The captive operator mechanism allows the hinge assembly 110 and 110' to be taken out of the locked position without removing any component or using a tool.

Both of the illustrated embodiments of the hinge assembly 110 and 110' include components that function to pivot portions of the tower 106, 106'. In the embodiment illustrated in FIGS. 2 to 6, these components include the first member 202, the second member 212, and the pivot bolt 518 rotatably coupled to the opening 510 in the second member 212. In the embodiment illustrated in FIGS. 10 to 14*b*, these components include the first member 202', the second member 212', and the shaft 116 of the lock plate 1112 rotatably coupled in the opening 510 in the first member 202'.

Both of the illustrated embodiments of the hinge assembly 110 and 110' include components that function to lock the pivoting portions of the tower 106, 106'. In the embodiment illustrated in FIGS. 2 to 6, these components include the spring 402 and the bolt 404, which is secured by the opening 406 in the first member 202 and slideably engages the corresponding opening 516 in the second member 212. In the embodiment illustrated in FIGS. 10 to 14*b*, these components include the locking pins 1124 which are secured to the second member 212' and slideably engage the openings 1106 in the first member 202'.

Both of the illustrated embodiments of the hinge assembly 110 and 110' include components that function to operate, or move, the locking mechanism of the pivoting portions of the tower 106, 106'. In the embodiment illustrated in FIGS. 2 to 6, these components include the operator 208, which is guided by an opening 206 in the first member 202. In the embodiment illustrated in FIGS. 10 to 14*b*, these components include the pushbutton 1002, which moves within an opening 1102 in the first member 202' and causes the locking assembly 1122 to retract the locking pins 1124 from the openings 1106 in the first member 202'.

The footer includes a footer body 702, a releasable member 714, and a spring-loaded footer bolt 708 with a footer operator 712. The footer bolt 708 slides along a bored hole 802. In the direction towards the first opening 716, the bolt 712 is forced by a footer spring 706, and in the opposition direction, the bolt 708 is moved by a footer operator 712

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, we claim:

1. A tower attached to a vehicle, such as a marine vessel, said tower comprising:

a first strut held in fixed relation to the vehicle;

a second strut having a first end and a second end;

a hinge assembly pivotably connecting said first strut to said second strut, said hinge assembly including a first member attached to said first strut;

a second member attached to said first end of said second strut, said second member pivotably connected to said first member;

an operator locking said first member to said second member in a locked position, said operator held captive in said hinge assembly;

a releasable footer for securing said second end of said second strut, said releasable footer including a body held in fixed relation to the vehicle, said body having a first opening;

a footer bolt movable within said body, said footer bolt movable between a retracted position and an extended position;

a releasable member adapted to be received by said first opening in said body, said releasable member having an opening adapted to receive said footer bolt when said releasable member is received by said first opening and said footer bolt is in said extended position;

whereby said tower folds when said second strut is released and said hinge assembly is unlocked.

2. The apparatus of claim 1 further including a lip extending from said first member and a slot formed in said second member, said lip engaging said slot when said first member and said second member are in a locked position.

3. The apparatus of claim 2 further including a lip extending from said second member and a slot formed in said first member, said lip engaging said slot when said first member and said second member are in said locked position.

4. The tower of claim 1 wherein said operator includes at least one locking pin held in fixed relation to said second member, said at least one locking pin engaging at least one corresponding opening in said first member, thereby locking said first member and second member in said locked position.

5. The tower of claim 4 wherein said operator further includes a spring cooperating with said at least one locking pin whereby said spring forces said at least one locking pin to engage said at least one corresponding opening.

6. The tower of claim 4 wherein said operator further includes a pushbutton connected to said at least one locking pin, said pushbutton causing said at least one locking pin to disengage said at least one corresponding opening.

7. The tower of claim 4 wherein said operator further includes means for moving said at least one locking pin between a retracted position and an extended position.

8. The tower of claim 1 wherein said operator includes a hinge bolt slideably engaging an opening in said first member in a fixed position.

9. The tower of claim 8 further including a chamfer on said first member adjacent said opening in said first member; said chamfer adapted to slideably engage said exposed end of said bolt whereby said bolt is pushed into an opening of said second member as said first member and said second member are aligned in a locked position.

10. The tower of claim 8 wherein said operator further includes a spring cooperating with said hinge bolt whereby said spring forces said hinge bolt to extend between said first member and said second member.

11. The tower of claim 8 wherein said operator further includes a sliding operator connected to said hinge bolt whereby said sliding operator causes said hinge bolt to move between a retracted position and an extended position.

12. The tower of claim 8 wherein said operator further includes means for moving said hinge bolt between a retracted position and an extended position.

13. The tower of claim 1 further including a second operator locking said first member to said second member in said locked position, said second operator held captive in said hinge assembly.

14. The tower of claim 1 further including a spring cooperating with said footer bolt whereby said spring forces said footer bolt to extend into said opening in said releasable member.

15. The tower of claim 1 further including means for moving said footer bolt between a retracted position and an extended position.

16. A tower attached to a vehicle, such as a marine vessel, said tower having an erect position and a folded position, said tower comprising:

a means for releasably securing one end of said tower to the vehicle;

a means for pivoting said tower between said erect position and said folded position;

a means for locking said means for pivoting in a fixed position when said tower is in said erect position; and a means for operating said means for locking.

17. An apparatus for folding a tower attached to a vehicle, such as a marine vessel, said apparatus comprising:

a first member attached to a first strut of the tower;

a second member attached to a second strut of the tower;

a means for pivoting said first member about said second member;

a means for locking said first member to said second member wherein said first strut is held in a fixed position relative to said second strut; and a means for operating said means for locking.

18. The tower of claim 16 wherein said means for releasably securing includes a releasable footer having a body, a spring loaded bolt, and a releasable member secured by said spring loaded bolt.

19. The tower of claim 16 wherein said means for pivoting includes a first member pivotably connected to a second member, said first member and said second member having a locked position wherein a spring loaded bolt in said first member engages an opening in said second member.

20. The tower of claim 16 wherein said means for pivoting includes a first member pivotably connected to a second member, said first member and said second member having a locked position wherein a spring loaded locking pin in said second member engages an opening in said first member.

21. An apparatus for folding a tower attached to a vehicle, such as a marine vessel, said apparatus comprising:

a first member having a first longitudinal axis and an opening;

a bolt extendable from a first end of said first member, said bolt having a first end disposed inside said opening in said first member and an exposed end, said bolt slideably engaging said opening in said first member, said bolt movable between a retracted position and an extended position, said bolt held captive in said apparatus;

a second member having a second longitudinal axis, said second member having an opening adapted to receive said exposed end of said bolt; and a pivot joining said first member to said second member, said first member and said second member being movable between a locked position and an unlocked position, when said first member and said second member are in said locked position, said exposed end of said bolt engages said opening of said second member and said first longitudinal axis is substantially parallel to said second longitudinal axis, when said first member and said second member are in said unlocked position, said first member pivots relative to said second member about said pivot.

22. The apparatus of claim 21 further including an operator attached to said bolt whereby said operator causes said bolt to slideably move within said opening of said first member.

23. The apparatus of claim 21 further including a spring disposed in said opening of said first member, said spring engaging said first end of said bolt.

24. The apparatus of claim 21 further including a means for moving said bolt between said retracted position and said extended position.

25. The apparatus of claim 21 further including a lip extending from said first member and a slot formed in said second member, said lip engaging said slot when said first member and said second member are in said locked position.

26. The apparatus of claim 25 further including a lip extending from said second member and a slot formed in said first member, said lip engaging said slot when said first member and said second member are in said locked position.

27. The apparatus of claim 21 further including a second bolt extendable from a first end of said second member, said second bolt having a first end disposed inside an opening in said second member and an exposed end, said bolt slideably engaging said opening in said second member; said first member having an opening adapted to receive said exposed end of said second bolt.

28. The apparatus of claim 21 further including a chamfer on said first member adjacent said first opening of said second member; said chamfer adapted to slideably engage said exposed end of said bolt whereby said bolt is pushed into said opening of said first member as said first member and said second member are aligned for said locked position.

29. An apparatus for folding a tower attached to a vehicle, such as a marine vessel, said apparatus comprising:

a first member having a first longitudinal axis, a first opening, and a second opening, said first member having a lip and a slot;

a second member having a second longitudinal axis, a first opening, and a second opening, said second member having a lip and a slot;

a first bolt extendable from a first end of said first member, said first bolt having a first end disposed inside said first opening in said first member and an exposed end, said first bolt slideably engaging said first opening in said first member, said exposed end of said first bolt engaging said second opening in said second member;

a first operator attached to said first bolt whereby said first operator causes said first bolt to slideably move within said first opening of said first member;

a first spring disposed in said first opening of said first member, said first spring engaging said first end of said first bolt;

a second bolt extendable from a first end of said second member, said second bolt having a first end disposed inside said first opening in said second member and an exposed end, said second bolt slideably engaging said first opening in said second member, said exposed end of said first bolt engaging said second opening in said first member;

a second operator attached to said second bolt whereby said second operator causes said second bolt to slideably move within said first opening of said second member;

a second spring disposed in said first opening of said second member, said second spring engaging said first end of said second bolt; and a pivot joining said first member to said second member, said first member and said second member being movable between a locked position and an unlocked position, when said first member and said second member are in said locked position, said exposed end of said first bolt engages said second opening of said second member, said exposed end of said second bolt engages said second opening of said first member, said lip of first member engages said slot of said second member, said lip of second member engages said slot of said first member, and said first longitudinal axis is substantially parallel to said second longitudinal axis, when said first member and said second member are in said unlocked position, said first member pivots relative to said second member about said pivot.

30. An apparatus for folding a tower attached to a vehicle, such as a marine vessel, said apparatus comprising:

a locking assembly having a shaft and at least one locking pin substantially parallel to said shaft;

a lock plate having a shaft with an opening adapted to slidably receive said locking assembly shaft, said lock plate shaft substantially perpendicular to a lock plate flange;

a pushbutton attached to said locking assembly shaft;

a first member having a first longitudinal axis, said first member having a first opening adapted to receive said pushbutton and a second opening adapted to receive said shaft of said lock plate whereby said shaft of said lock plate is rotatable within said second opening, said first opening axially aligned with said second opening, said first member having at least one third opening adapted to receive said at least one locking pin;

a second member having a second longitudinal axis, said second member having a first opening adapted to slidably receive said locking assembly and a second opening adapted to receive and secure said lock plate flange; and a spring positioned between said pushbutton and said second opening in said first member whereby said spring forces said pushbutton away from said second opening in said first member and forces said at least one locking pin to engage at least one third opening in said first member, thereby locking said first member to said second member.

31. The apparatus of claim 30 further including a lip extending from said first member and a slot formed in said second member, said lip engaging said slot when said first member and said second member are locked together.

32. The apparatus of claim 31 further including a lip extending from said second member and a slot formed in said first member, said lip engaging said slot when said first member and said second member are locked together.

33. An apparatus for attaching a tower to a vehicle, such as a marine vessel, said apparatus comprising:

a body held in fixed relation to the vehicle, said body having a first opening and a second opening, said first opening substantially perpendicular to said second opening;

a footer bolt movable within said second opening in said body, said footer bolt movable between a retracted position and an extended position, said footer bolt held captive in said body;

a releasable member adapted to be received by said first opening in said body, said releasable member having an opening adapted to receive said footer bolt when said releasable member is received by said first opening and said footer bolt is in said extended position.

34. The releasable footer of claim 33 further including a spring disposed in said second opening, said spring acting on said footer bolt to force said footer bolt into said extended position.

35. The releasable footer of claim 33 further including a means for moving said footer bolt between said retracted position and said extended position.

36. An apparatus for attaching a tower to a vehicle, such as a marine vessel, said apparatus comprising:

a means for releasably securing a portion of the tower to the vehicle;

a means for locking said means for releasably securing; and a means for operating said means for locking.

* * * * *